US006207622B1

(12) United States Patent
Li et al.

(10) Patent No.: US 6,207,622 B1
(45) Date of Patent: Mar. 27, 2001

(54) WATER-RESISTANT CONVEYOR LUBRICANT AND METHOD FOR TRANSPORTING ARTICLES ON A CONVEYOR SYSTEM

(75) Inventors: Minyu Li, Oakdale; Keith Darrell Lokkesmoe, Savage; Michael Edward Besse, Golden Valley, all of MN (US)

(73) Assignee: Ecolab, St. Paul, MN (US)

( * ) Notice: Subject to any disclaimer, the term of this patent is extended or adjusted under 35 U.S.C. 154(b) by 0 days.

(21) Appl. No.: 09/596,697

(22) Filed: Jun. 19, 2000

(51) Int. Cl.[7] ..... C10M 105/08; C10M 173/00

(52) U.S. Cl. ..... 508/208; 508/485; 508/579; 508/583; 508/590

(58) Field of Search ..... 508/208, 590

(56) References Cited

U.S. PATENT DOCUMENTS

| | | | | |
|---|---|---|---|---|
| 3,011,975 | | 12/1961 | Nitzsche et al. | 508/138 |
| 3,213,024 | | 10/1965 | Blake et al. | 508/116 |
| 3,664,956 | | 5/1972 | Messina et al. | 508/183 |
| 3,981,812 | | 9/1976 | Zletz | 508/209 |
| 4,324,671 | | 4/1982 | Christian et al. | 508/183 |
| 4,436,200 | | 3/1984 | Hodlewski et al. | 198/851 |
| 4,828,727 | | 5/1989 | McAninch | 508/534 |
| 4,929,375 | | 5/1990 | Rossio et al. | 508/415 |
| 5,009,801 | | 4/1991 | Wider et al. | 508/390 |
| 5,062,979 | * | 11/1991 | Scharf et al. | 252/49.3 |
| 5,073,280 | | 12/1991 | Rossio et al. | 508/410 |
| 5,160,646 | | 11/1992 | Scheld | 508/183 |
| 5,174,914 | | 12/1992 | Gutzmann | 508/410 |
| 5,182,035 | | 1/1993 | Schmidt et al. | 508/527 |
| 5,191,779 | | 3/1993 | Imaja et al. | 72/46 |
| 5,334,322 | | 8/1994 | Williams, Jr. | 508/579 |
| 5,352,376 | | 10/1994 | Gutzmann | 508/216 |
| 5,474,692 | * | 12/1995 | Laufenberg et al. | 252/34 |
| 5,486,316 | | 1/1996 | Bershas et al. | 134/18 |
| 5,559,087 | | 9/1996 | Halsrud et al. | 508/579 |

(List continued on next page.)

FOREIGN PATENT DOCUMENTS

| | | |
|---|---|---|
| 1157456A | 11/1983 | (CA) . |
| 1564128 | 4/1980 | (GB) . |
| 57003892 | 1/1982 | (JP) . |
| 6-136377 | 5/1994 | (JP) . |
| 10053679A | 8/1996 | (JP) . |
| 9300742 | 5/1993 | (NL) . |

OTHER PUBLICATIONS

"The Alternative to Soap and Water for Lubricating Conveyor Lines," *Food & Drink Business*, pp. 35–36 (Jan. 1998).

(List continued on next page.)

*Primary Examiner*—Ellen M. McAvoy
(74) *Attorney, Agent, or Firm*—David R. Cleveland PA

(57) ABSTRACT

The passage of a container along a conveyor is lubricated by applying to the container or conveyor a phase-separating mixture of a hydrophilic lubricating material and an oleophilic lubricating material whose specific gravity is less than or equal to the specific gravity of the hydrophilic lubricating material. Prior to being applied to the container or conveyor, the mixture is agitated or otherwise maintained in a mixed but unstable state. Following application, the hydrophilic lubricating material and oleophilic lubricating material tend to undergo phase-separation, with the oleophilic lubricating material typically forming a film atop the hydrophilic lubricating material, thereby providing a water-repelling lubricating layer having reduced water sensitivity. The mixture can be applied in relatively low amounts and with relatively low or no water content, to provide thin, substantially non-dripping lubricating films. In contrast to dilute aqueous lubricants, the lubricants of the invention provide drier lubrication of the conveyors and containers, a cleaner conveyor line and reduced lubricant usage, thereby reducing waste, cleanup and disposal problems.

45 Claims, 1 Drawing Sheet

U.S. PATENT DOCUMENTS

| | | | | |
|---|---|---|---|---|
| 5,565,127 | * | 10/1996 | Laufenberg et al. | 508/220 |
| 5,663,131 | * | 9/1997 | Winicov et al. | 508/580 |
| 5,672,401 | | 9/1997 | Anglin et al. | 428/64.1 |
| 5,863,874 | | 1/1999 | Person Hei et al. | 508/521 |
| 5,869,436 | | 2/1999 | Lindman | 508/174 |
| 5,925,601 | | 7/1999 | McSherry | 508/425 |
| 5,935,914 | | 8/1999 | Theyssen et al. | 508/517 |

OTHER PUBLICATIONS

Lubrication and Lubricants, *Encyclopedia of Chemical Technology*, vol. 15, pp. 463–517.

"A fracture mechanics approach to environmental stress cracking in poly(ethyleneterephthalate)," *Polymer*, vol. 39 No. 3, pp. 75–80 (1998).

Material Safety Data Sheet for Lubostar CP (May 3, 2000).

"Environmental Stress Cracking in PET Carbonated Soft Drink Containers," Eric J. Moskala, Ph.D., Eastman Chemical Company, presented at Bev Tech 98 (Savannah, GA).

"Environmental Stress Cracking Resistance of Blow Molded Poly(Ethylene Terephthalate) Containers," *Polymer Engineering and Science*, vol. 32, No. 6, pp. 393–399 (Mar. 1992).

* cited by examiner

WATER-RESISTANT CONVEYOR LUBRICANT AND METHOD FOR TRANSPORTING ARTICLES ON A CONVEYOR SYSTEM

TECHNICAL FIELD

This invention relates to conveyor lubricants and to a method for conveying articles. The invention also relates to conveyor systems and containers wholly or partially coated with such lubricant compositions.

BACKGROUND ART

In commercial container filling or packaging operations, the containers typically are moved by a conveying system at very high rates of speed. Copious amounts of aqueous dilute lubricant solutions (usually based on fatty acid amines) are typically applied to the conveyor or containers using spray or pumping equipment. These lubricant solutions permit high-speed operation of the conveyor and limit marring of the containers or labels, but also have some disadvantages. For example, aqueous conveyor lubricants based on fatty amines typically contain ingredients that can react with spilled carbonated beverages or other food or liquid components to form solid deposits. Formation of such deposits on a conveyor can change the lubricity of the conveyor and require shutdown to permit cleanup. Some aqueous conveyor lubricants are incompatible with thermoplastic beverage containers made of polyethylene terephthalate (PET) and other plastics, and can cause environmental stress cracking (crazing and cracking that occurs when the plastic polymer is under tension) in plastic containers. Dilute aqueous lubricants typically require use of large amounts of water on the conveying line, which must then be disposed of or recycled, and which causes an unduly wet environment near the conveyor line. Moreover, some aqueous lubricants can promote the growth of microbes.

SUMMARY OF THE INVENTION

During some packaging operations such as beverage container filling, the containers are sprayed with warm water in order to warm the filled containers and discourage condensation on the containers downstream from the filling station. This warm water spray can dilute the conveyor lubricant and reduce its lubricity.

The present invention provides, in one aspect, a method for lubricating the passage of a container along a conveyor comprising applying a phase-separating mixture of a hydrophilic lubricating material and an oleophilic lubricating material whose specific gravity is less than or equal to the specific gravity of the hydrophilic lubricating material, to at least a portion of the container-contacting surface of the conveyor or to at least a portion of the conveyor-contacting surface of the container. Prior to application to a conveyor or container, the mixture is agitated or otherwise maintained in a mixed but unstable state. Following application, the hydrophilic lubricating material and oleophilic lubricating material tend to undergo phase-separation, and we believe that the oleophilic lubricating material may tend to form a continuous or discontinuous film atop the hydrophilic lubricating material thereby providing a water-repelling lubricating layer having reduced water sensitivity.

The present invention provides, in another aspect, a lubricated conveyor or container, having a lubricant coating on a container-contacting surface of the conveyor or on a conveyor-contacting surface of the container, wherein the coating comprises phase-separated layers of oleophilic lubricating material and a hydrophilic lubricating material.

The present invention also provides lubricating compositions for use on containers and conveyors, comprising an unstable mixture of an oleophilic lubricating material and a hydrophilic lubricating material.

The compositions used in the invention can be applied in relatively low amounts and do not require in-line dilution with significant amounts of water. The compositions of the invention provide thin, substantially non-dripping lubricating films. In contrast to dilute aqueous lubricants, the lubricants of the invention provide drier lubrication of the conveyors and containers, a cleaner and drier conveyor line and working area, and reduced lubricant usage, thereby reducing waste, cleanup and disposal problems.

DETAILED DESCRIPTION

Figure 1:
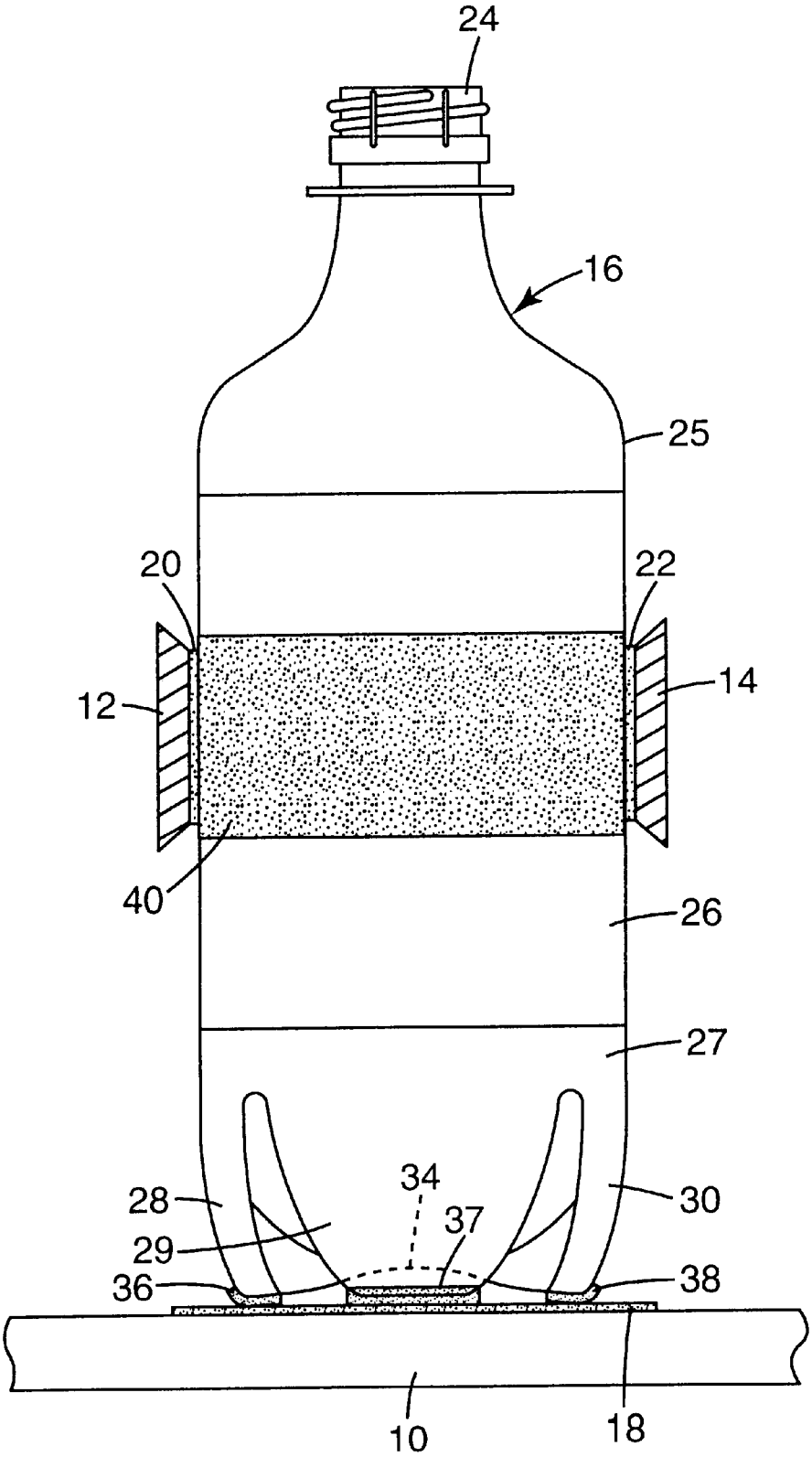
FIG. 1 illustrates in partial cross-section a side view of a plastic beverage container and conveyor partially coated with a lubricant composition of the invention.

The invention provides a lubricant coating that reduces the coefficient of friction of coated conveyor parts and containers and thereby facilitates movement of containers along a conveyor line. The lubricant compositions used in the invention can optionally contain water or a suitable diluent, as a component or components in the lubricant composition as sold or added just prior to use. The lubricant composition does not require in-line dilution with significant amounts of water, that is, it can be applied undiluted or with relatively modest dilution, e.g., at a water:lubricant ratio of about 1:1 to 5:1. In contrast, conventional dilute aqueous lubricants are applied using dilution ratios of about 100:1 to 500:1. The lubricant compositions preferably provide a renewable coating that can be reapplied, if desired, to offset the effects of coating wear. They preferably can be applied while the conveyor is at rest or while it is moving, e.g., at the conveyor's normal operating speed. The lubricant coating preferably is substantially non-dripping, that is, preferably the majority of the lubricant remains on the container or conveyor following application until such time as the lubricant may be deliberately washed away.

The lubricant composition resists loss of lubricating properties in the presence of water or hydrophilic fluids, but can readily be removed from the container or conveyor using conventional aqueous cleaners, without the need for high pressure, mechanical abrasion or the use of aggressive cleaning chemicals. The lubricant composition can provide improved compatibility with plastic conveyor parts and plastic bottles, because the composition does not require inclusion of emulsifiers or other surfactants that can promote stress cracking in plastics such as PET.

The invention is further illustrated in FIG. 1, which shows a conveyor belt 10, conveyor chute guides 12, 14 and beverage container 16 in partial cross-sectional view. The container-contacting portions of belt 10 and chute guides 12, 14 are coated with thin layers 18, 20 and 22 of a lubricant composition of the invention. Container 16 is constructed of blow-molded PET, and has a threaded end 24, side 25, label 26 and base portion 27. Base portion 27 has feet 28, 29 and 30, and crown portion (shown partially in phantom) 34. Thin layers 36, 37 and 38 of a lubricant composition of the invention cover the conveyor-contacting portions of container 16 on feet 28, 29 and 30, but not crown portion 34. Thin layer 40 of a lubricant composition of the invention covers the conveyorcontacting portions of container 16 on label 26.

A variety of hydrophilic lubricating materials can be employed in the lubricant compositions, including hydroxy-containing compounds such as polyols (e.g., glycerol and propylene glycol); polyalkylene glycols (e.g., the CARBOWAX™ series of polyethylene and methoxypolyethylene glycols, commercially available from Union Carbide Corp.); linear copolymers of ethylene and propylene oxides (e.g., UCON™ 50-HB-100 water-soluble ethylene oxide:propylene oxide copolymer, commercially available from Union Carbide Corp.); and sorbitan esters (e.g., TWEEN™ series 20, 40, 60, 80 and 85 polyoxyethylene sorbitan monooleates and SPAN™ series 20, 80, 83 and 85 sorbitan esters, commercially available from ICI Surfactants). Other suitable hydrophilic lubricating materials include phosphate esters, amines and their derivatives, and other commercially available hydrophilic lubricating materials that will be familiar to those skilled in the art. Derivatives (e.g., partial esters or ethoxylates) of the above hydrophilic lubricating materials can also be employed. For applications involving plastic containers, care should be taken to avoid, the use of hydrophilic lubricating materials that might promote environmental stress cracking in plastic containers when evaluated using the PET Stress Crack Test set out below. Preferably the hydrophilic lubricating material is a polyol such as glycerol, whose specific gravity is 1.25 for a 96 wt. % solution of glycerol in water.

A variety of oleophilic lubricating materials can be employed in the invention. Because the oleophilic lubricating material has a specific gravity that is less than or equal to the specific gravity of the hydrophilic lubricating material, the choice of oleophilic lubricating material will be influenced in part by the choice of hydrophilic lubricating material. Preferably the oleophilic lubricating material is substantially "water-immiscible", that is, the material preferably is sufficiently water-insoluble so that when added to water at the desired use level, the oleophilic lubricating material and water form separate phases. The desired use level will vary according to the particular conveyor or container application, and according to the type of oleophilic lubricating material and hydrophilic lubricating material employed. Preferred oleophilic lubricating materials include silicone fluids, fluorochemical fluids and hydrocarbons. Suitable silicone fluids include methyl alkyl silicones such as SF1147 and SF8843 silicone fluids with respective specific gravities of 0.89 and 0.95–1.10, both commercially from GE Silicones. Preferred hydrocarbons include vegetable oils (e.g., corn oil) and mineral oils (e.g., mineral seal oil with a specific gravity of 0.816, commercially available from Calument Lubricant Co.; BACCHUS™ 22 mineral oil, commercially available from Vulcan Oil and Chemical Products; and ARIADNE™ 22 mineral oil having a specific gravity of 0.853–0.9, also commercially available from Vulcan Oil and Chemical Products). For applications involving plastic containers, care should be taken to avoid the use of oleophilic lubricating materials that might promote environmental stress cracking in plastic containers when evaluated using the PET Stress Crack Test set out below. Preferably the oleophilic lubricating material comprises a mineral oil or mineral seal oil.

If water is employed in the lubricant compositions, preferably it is deionized water. Suitable other diluents include alcohols such as isopropyl alcohol. For applications involving plastic containers, care should be taken to avoid the use of water or other diluents containing contaminants that might promote environmental stress cracking in plastic containers when evaluated using the PET Stress Crack Test set out below.

Preferred amounts for the hydrophilic lubricating material, oleophilic lubricating material and optional water or other diluent are about 30 to about 99.9 wt. % of the hydrophilic lubricating material, about 0.1 to about 30 wt. % of the oleophilic lubricating material and 0 to about 69.9 wt. % of water or other diluent. More preferably, the lubricant composition contains about 50 to about 90 wt. % of the hydrophilic lubricating material, about 1 to about 15 wt. % of the oleophilic lubricating material, and about 2 to about 49 wt. % of water or other diluent. Most preferably, the lubricant composition contains about 65 to about 85 wt. % of the hydrophilic lubricating material, about 2 to about 10 wt. % of the oleophilic lubricating material, and about 8 to about 33 wt. % of water or other diluent.

Formation of an unstable mixture and promotion of early phase separation will be aided by avoiding the use of emulsifiers or other surfactants that often are employed in conveyor lubricants. Because many emulsifiers promote environmental stress cracking in blow-molded polyethylene terephthalate bottles, the invention thus permits a desirable reduction in or elimination of ingredients that might otherwise cause PET stress cracking. Preferably the lubricant composition is substantially free of surfactants.

The lubricant compositions can contain additional components if desired. For example, the compositions can contain adjuvants such as conventional waterborne conveyor lubricants (e.g., fatty acid lubricants), antimicrobial agents, colorants, foam inhibitors or foam generators, cracking inhibitors (e.g., PET stress cracking inhibitors), viscosity modifiers, film forming materials, antioxidants or antistatic agents. The amounts and types of such additional components will be apparent to those skilled in the art.

For applications involving plastic containers, the lubricant compositions preferably have a total alkalinity equivalent to less than about 100 ppm $CaCO_3$, more preferably less than about 50 ppm $CaCO_3$, and most preferably less than about 30 ppm $CaCO_3$, as measured in accordance with Standard Methods for the Examination of Water and Wastewater, $18^{th}$ Edition, Section 2320, Alkalinity.

The lubricant compositions preferably have a coefficient of friction (COF) that is less than about 0.14, more preferably less than about 0.1, when evaluated using the Short Track Conveyor Test described below.

A variety of kinds of conveyors and conveyor parts can be coated with the lubricant composition. Parts of the conveyor that support or guide or move the containers and thus are preferably coated with the lubricant composition include belts, chains, gates, chutes, sensors, and ramps having surfaces made of fabrics, metals, plastics, composites, or combinations of these materials.

The lubricant composition can also be applied to a wide variety of containers including beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The containers can have a variety of sizes and forms, including cartons (e.g., waxed cartons or TETRAPACK™ boxes), cans, bottles and the like. Although any desired portion of the container can be coated with the lubricant composition, the lubricant composition preferably is applied only to parts of the container that will come into contact with the conveyor or with other containers. Preferably, the lubricant composition is not applied to portions of thermoplastic containers that are prone to stress cracking. In a preferred embodiment of the invention, the lubricant composition is applied to the crystalline foot portion of a blow-molded, footed PET container (or to one or more portions of a conveyor that will contact such foot portion) without applying significant quantities of lubricant composition to the amorphous center base portion of the container. Also, the lubricant composition preferably is not applied to portions of a container that might later be gripped by a user holding the container, or, if so applied, is preferably removed from such portion prior to shipment and sale of the container. For some such applications the lubricant composition preferably is applied to the conveyor rather than to the container, in order to limit the extent to which the container might later become slippery in actual use.

The lubricant composition can be a liquid or semi-solid at the time of application. Preferably the lubricant composition is a liquid having a viscosity that will permit it to be pumped and readily applied to a conveyor or containers, and that will facilitate rapid film formation and phase separation whether or not the conveyor is in motion. The lubricant composition can be formulated so that it exhibits shear thinning or other pseudo-plastic behavior, manifested by a higher viscosity (e.g., non-dripping behavior) when at rest, and a much lower viscosity when subjected to shear stresses such as those provided by pumping, spraying or brushing the lubricant composition. This behavior can be brought about by, for example, including appropriate types and amounts of thixotropic fillers (e.g., treated or untreated fumed silicas) or other rheology modifiers in the lubricant composition. The lubricant coating can be applied in a constant or intermittent fashion. Preferably, the lubricant coating is applied in an intermittent fashion in order to minimize the amount of applied lubricant composition. For example, the lubricant composition can be applied for a period of time during which at least one complete revolution of the conveyor takes place. Application of the lubricant composition can then be halted for a period of time (e.g., minutes or hours) and then resumed for a further period of time (e.g., one or more further conveyor revolutions). The lubricant coating should be sufficiently thick to provide the desired degree of lubrication, and sufficiently thin to permit economical operation and to discourage drip formation. The lubricant coating thickness preferably is maintained at at least about 0.0001 mm, more preferably about 0.001 to about 2 mm, and most preferably about 0.005 to about 0.5 mm.

Prior to application to the conveyor or container, the lubricant composition should be mixed sufficiently so that the lubricant composition is not substantially phase-separated. Mixing can be carried out using a variety of devices. For example, the lubricant composition or its individual components can be added or metered into a mixing vessel equipped with a suitable stirrer. The stirred lubricant composition can then be pumped to the conveyor or containers (or to both conveyors and containers) using a suitable piping system. Preferably a relatively small bore piping system equipped with a suitable return line to the mixing vessel is employed in order to maintain the lubricating composition in an unstable, adequately mixed condition prior to application. Application of the lubricant composition can be carried out using any suitable technique including spraying, wiping, brushing, drip coating, roll coating, and other methods for application of a thin film. If desired, the lubricant composition can be applied using spray equipment designed for the application of conventional aqueous conveyor lubricants, modified as need be to suit the substantially lower application rates and preferred non-dripping coating characteristics of the lubricant compositions used in the invention. For example, the spray nozzles of a conventional beverage container lube line can be replaced with smaller spray nozzles or with brushes, or the metering pump can be altered to reduce the metering rate. Preferably the lubricant composition is applied sufficiently upstream from any water spray or other source of water spillage on the conveyor line so that the lubricant composition will have time to undergo phase separation before it may be exposed to water.

The lubricant compositions can if desired be evaluated using a Short Track Conveyor Test and a PET Stress Crack Test.

Short Track Conveyor Test

A conveyor system employing a motor-driven 83 mm wide by 6.1 meter long REXNORD™ LF polyacetal thermoplastic conveyor belt is operated at a belt speed of 30.48 meters/minute. Six 2-liter filled PET beverage bottles are stacked in an open-bottomed rack and allowed to rest on the moving belt. The total weight of the rack and bottles is 16.15 Kg. The rack is held in position on the belt by a wire affixed to a stationary strain gauge. The force exerted on the strain gauge during belt operation is recorded using a computer. A thin, even coat of the lubricant composition is applied to the surface of the belt using an applicator made from a conventional bottle wash brush. The belt is allowed to run for 15 minutes during which time a consistently low COF is observed. The COF is calculated on the basis of the measured force and the mass of the bottles, averaged over the run duration. Next, 60 ml of warm water is sprayed over a 30 second period onto the conveyor surface, just upstream from the rack (under the wire). Application of the lubricant is continued for another 5 minutes, and the average COF following the water spray and the resulting change in average COF are noted.

PET Stress Crack Test

Standard 2-liter PET beverage bottles (commercially available from Constar International) are charged with 1850 g of chilled water, 31.0 g of sodium bicarbonate and 31.0 g of citric acid. The charged bottle is capped, rinsed with deionized water and set on clean paper towels overnight. The bottoms of 6 bottles are dipped in a 200 g sample of the undiluted lube in a 125×65 mm crystal dish, then placed in a bin and stored in an environmental chamber at 37.8° C., 90% relative humidity for 14 days. The bottles are removed from the chamber, observed for crazes, creases and crack patterns on the bottom. The aged bottles are compared with 6 control bottles that were exposed to a comparison lubricant composition placed in the crystal dish, or exposed to a standard dilute aqueous lubricant (LUBODRIVE™ RX, commercially available from Ecolab) prepared as follows. A 1.7 wt. % solution of the LUBODRIVE lubricant (in water containing 43 ppm alkalinity as $CaCO_3$) was foamed for several minutes using a mixer. The foam was transferred to a lined bin and the control bottles were dipped in the foam. The bottles were then aged in the environmental chamber as outlined above.

The invention can be better understood by reviewing the following examples. The examples are for illustration purposes only, and do not limit the scope of the invention.

EXAMPLE 1

75 parts of a 96 wt. % glycerol solution, 20 parts deionized water, and 5 parts mineral seal oil (commercially available from Calument Lubricant Co.) were combined with stirring. The resulting lubricant composition was unstable and quickly separated into two phases upon standing. When re-agitated and applied to a surface, the lubricant composition formed a film that was slippery to the touch, and most of the lubricant readily could be rinsed from the surface using a plain water wash. Using the Short Track Conveyor Test, about 20 g of the lubricant composition was applied to the moving belt. The observed average COF was 0.066 before the water spray began, and 0.081 after the spray began, for a 0.015 increase in average COF due to the water spray.

In a comparison run, 74.3 parts of a 96 wt. % glycerol solution, 19.8 parts deionized water, 5 parts mineral seal oil (commercially available from Calument Lubricant Co.) and 0.99 parts SHEREX VEROINC™ T205 emulsifier (commercially available from Akzo Nobel Chemicals) were combined with stirring. The resulting lubricant composition was a stable emulsion that remained as a single-phase mixture upon standing. Using the Short Track Conveyor Test, about 20 g of the comparison lubricant composition was applied to the moving belt. The observed average COF was 0.073 before the water spray began, and 0.102 after the spray began, for a 0.029 increase in average COF due to the water spray. The COF for the comparison lubricant composition (which contained an emulsifier) increased almost twice as much in the presence of a water spray as the COF for the unstable lubricant composition of the invention. Thus the comparison lubricant composition was not as water-resistant as a lubricant composition of the invention.

The lubricant composition of this Example 1 and the comparison lubricant composition were also evaluated using the PET Stress Crack Test. The bottles exposed to the lubricant composition of the invention exhibited frequent small, shallow crazing marks and infrequent medium depth crazing marks. The bottles exposed to the comparison lubricant composition exhibited frequent medium depth crazing marks. Thus the bottoms of bottles lubricated with a lubricant composition of the invention had a better visual appearance after aging. No bottles leaked or burst for the lubricant composition of the invention. One of the bottles exposed to the comparison lubricant composition burst on day 9. This invention shows that a lubricant composition of the invention provided better burst and stress crack resistance than the comparison lubricant composition.

In a further comparison Short Track Conveyor test performed using a dilute aqueous solution of a standard conveyor lubricant (LUBODRIVE™ RX, commercially available from Ecolab, applied using a 0.5% dilution in water and about an 8 liter/hour spray application rate), the observed COF was 0.126, thus indicating that the lubricant composition of the invention provided reduced sliding friction compared to a standard dilute aqueous lubricant.

EXAMPLE 2

Using the method of Example 1, 95 parts of a 96 wt. % glycerol solution and 5 parts mineral seal oil were combined with stirring. The resulting lubricant composition was unstable and quickly separated into two phases upon standing. When re-agitated and applied to a surface, the lubricant composition formed a film that was slippery to the touch, and most of the lubricant readily could be rinsed from the surface using a plain water wash. Using the Short Track Conveyor Test, about 20 g of the lubricant composition was applied to the moving belt. The observed average COF was 0.061 before the water spray began, and 0.074 after the spray began, for a 0.013 change in average COF.

EXAMPLE 3

Using the method of Example 1, 75 parts of a 96 wt. % glycerol solution, 20 parts deionized water and 5 parts mineral oil (ARIADNE™ 22, commercially available from Vulcan Oil and Chemical Products) were combined with stirring until a uniform mixture was obtained. The resulting lubricant composition was unstable and quickly separated into two phases upon standing. When re-agitated and applied to a surface, the lubricant composition formed a film that was slippery to the touch, and most of the lubricant readily could be rinsed from the surface using a plain water wash. Using the Short Track Conveyor Test, about 20 g of the lubricant composition was applied to the moving belt. The observed average COF was 0.072 before the water spray began, and 0.083 after the spray began, for a 0.011 change in average COF.

The lubricant composition of this Example 3 was also evaluated using the PET Stress Crack Test. Following aging, the bottles exhibited frequent small, shallow crazing marks and infrequent medium depth crazing marks. None of the bottles leaked or burst.

EXAMPLE 4

Using the method of Example 1, 77.24 parts of a 96 wt. % glycerol solution, 20.71 parts deionized water and 2.05 parts mineral seal oil were combined with stirring until a uniform mixture was obtained. The resulting lubricant composition was unstable and quickly separated into two phases upon standing. When re-agitated and applied to a surface, the lubricant composition formed a film that was slippery to the touch, and most of the lubricant readily could be rinsed from the surface using a plain water wash.

Various modifications and alterations of this invention will be apparent to those skilled in the art without departing from the scope and spirit of the invention, and are intended to be within the scope of the following claims.

We claim:

1. A method for lubricating the passage of a container along a conveyor, comprising applying a phase-separating mixture of a hydrophilic lubricating material and an oleophilic lubricating material whose specific gravity is less than or equal to the specific gravity of the hydrophilic lubricating material, to at least a portion of the container-contacting surface of the conveyor or to at least a portion of the conveyor-contacting surface of the container.

2. A method according to claim 1, wherein the mixture forms a substantially non-dripping film.

3. A method according to claim 1, wherein the mixture can be applied without requiring in-line dilution with significant amounts of water.

4. A method according to claim 1, wherein the mixture can readily be removed using a water-based cleaning agent.

5. A method according to claim 1, wherein the applied mixture undergoes phase-separation and provides a water-repelling lubricating layer having reduced water sensitivity.

6. A method according to claim 1, wherein the mixture is formed without adding surfactants that cause environmental stress cracking in polyethylene terephthalate.

7. A method according to claim 1, wherein the mixture comprises about 30 to about 99.9 wt. % of the hydrophilic lubricating material and about 0.1 to about 30 wt. % of the oleophilic lubricating material.

8. A method according to claim 1, wherein the mixture also comprises water or other diluent.

9. A method according to claim 8, wherein the mixture comprises about 50 to about 90 wt. % of the hydrophilic lubricating material, about 1 to about 15 wt. % of the oleophilic lubricating material, and about 2 to about 49 wt. % of water or other diluent.

10. A method according to claim 1, wherein the hydrophilic lubricating material comprises a hydroxy-containing compound, polyalkylene glycol, copolymer of ethylene and propylene oxides, sorbitan ester or derivative of any of the foregoing.

11. A method according to claim 1, wherein the hydrophilic lubricating material comprises a phosphate ester or amine or derivative of either of the foregoing.

12. A method according to claim 1, wherein the hydrophilic lubricating material comprises glycerol.

13. A method according to claim 1, wherein the oleophilic lubricating material comprises silicone fluid, fluorochemical fluid or hydrocarbon.

14. A method according to claim 1, wherein the oleophilic lubricating material comprises mineral oil or mineral seal oil.

15. A method according to claim 1, wherein the mixture has a total alkalinity equivalent to less than about 100 ppm $CaCO_3$.

16. A method according to claim 15, wherein the total alkalinity equivalent is less than about 30 ppm $CaCO_3$.

17. A method according to claim 1, wherein the mixture has a coefficient of friction less than about 0.14.

18. A method according to claim 17, wherein the coefficient of friction is less than about 0.1.

19. A method according to claim 1, wherein the containers comprise polyethylene terephthalate or polyethylene naphthalate.

20. A method according to claim 1, wherein the mixture is applied only to those portions of the conveyor that will contact the containers, or only to those portions of the containers that will contact the conveyor.

21. A method according to claim 1, wherein the mixture exhibits shear thinning while being applied and is non-dripping when at rest.

22. A lubricated conveyor or container, having a lubricant coating on a container-contacting surface of the conveyor or on a conveyor-contacting surface of the container, wherein the coating comprises phase-separated layers of oleophilic lubricating material and hydrophilic lubricating material.

23. A conveyor or container according to claim 22, wherein the coating forms a substantially non-dripping film.

24. A conveyor or container according to claim 22, wherein the mixture can be applied without requiring in-line dilution with significant amounts of water.

25. A conveyor or container according to claim 22, wherein the coating can readily be removed using a water-based cleaning agent.

26. A conveyor or container according to claim 22, wherein the oleophilic lubricating material forms a film atop the hydrophilic lubricating material, thereby providing a water-repelling lubricating layer having reduced water sensitivity.

27. A conveyor or container according to claim 22, wherein the coating was formed without adding surfactants that cause environmental stress cracking in polyethylene terephthalate.

28. A conveyor or container according to claim 22, wherein the coating comprises about 50 to about 90 wt. % of the hydrophilic lubricating material, about 1 to about 15 wt. % of the oleophilic lubricating material, and further comprises about 2 to about 49 wt. % of water or other diluent.

29. A conveyor or container according to claim 22, wherein the oleophilic lubricating material comprises a silicone fluid, fluorochemical fluid or hydrocarbon.

30. A conveyor or container according to claim 22, wherein the coating comprises a mineral oil or mineral seal oil, glycerol and water.

31. A conveyor or container according to claim 22, wherein the coating has a total alkalinity equivalent to less than about 100 ppm $CaCO_3$ and the containers comprise polyethylene terephthalate or polyethylene naphthalate.

32. A conveyor or container according to claim 31, wherein the total alkalinity equivalent is less than about 30 ppm $CaCO_3$.

33. A conveyor or container according to claim 32, wherein the containers comprise crystalline and amorphous surface portions and the coating contacts one or more crystalline surface portions of the container but does not contact significant amorphous surface portions of the container.

34. Conveyor and container lubricant compositions comprising an unstable mixture of an oleophilic lubricating material and a hydrophilic lubricating material.

35. A lubricant composition according to claim 34, wherein the mixture can readily be removed from a surface using a water-based cleaning agent.

36. A lubricant composition according to claim 34, wherein when the mixture is applied to a surface the oleophilic lubricating material forms a film with the hydrophilic lubricating material, thereby providing a water-repelling lubricating layer having reduced water sensitivity.

37. A lubricant composition according to claim 34, wherein the mixture comprises about 30 to about 99.9 wt. % of the hydrophilic lubricating material and about 0.1 to about 30 wt. % of the oleophilic lubricating material.

38. A lubricant composition according to claim 34, wherein the mixture comprises about 50 to about 90 wt. % of the hydrophilic lubricating material, about 1 to about 15 wt. % of the oleophilic lubricating material, and further comprises about 2 to about 49 wt. % of water or other diluent.

39. A lubricant composition according to claim 34, wherein the mixture comprises about 65 to about 85 wt. % of the hydrophilic lubricating material, about 2 to about 10 wt. % of the oleophilic lubricating material, and further comprises about 8 to about 33 wt. % of water or other diluent.

40. A lubricant composition according to claim 34, wherein the hydrophilic lubricating material comprises a hydroxy-containing compound, polyalkylene glycol, copolymer of ethylene and propylene oxides, sorbitan ester or derivative of any of the foregoing.

41. A lubricant composition according to claim 34, wherein the hydrophilic lubricating material comprises a phosphate ester, amine or derivative of either of the foregoing.

42. A lubricant composition according to claim 34, wherein the mixture comprises mineral oil or mineral seal oil.

43. A lubricant composition according to claim 34, wherein the mixture comprises glycerol.

44. A lubricant composition according to claim 34, wherein the mixture comprises a silicone emulsion, glycerol and water.

45. A lubricant composition according to claim 34, wherein the mixture is substantially free of surfactants that cause stress cracking in PET.

* * * * *

UNITED STATES PATENT AND TRADEMARK OFFICE

CERTIFICATE OF CORRECTION

PATENT NO. : 6,207,622 B1
DATED : March 27, 2001
INVENTOR(S) : Minyu Li, Keith D. Lokkesmoe, Michael E. Besse It is certified that error appears in the above-identified patent and that said Letters Patent is hereby corrected as shown below:

Title page,
"Filed: Jun. 19, 2000"should read -- Filed: Jun. 16, 2000 --.

Signed and Sealed this

Eighteenth Day of December, 2001

*Attest:*

*Attesting Officer*

JAMES E. ROGAN
*Director of the United States Patent and Trademark Office*